US009151295B2

(12) United States Patent
Avedon

(10) Patent No.: US 9,151,295 B2
(45) Date of Patent: Oct. 6, 2015

(54) COLUMNAR AIR MOVING DEVICES, SYSTEMS AND METHODS

(75) Inventor: Raymond B. Avedon, Boulder, CO (US)

(73) Assignee: Airius IP Holdings, LLC, Longmont, CO (US)

( * ) Notice: Subject to any disclaimer, the term of this patent is extended or adjusted under 35 U.S.C. 154(b) by 594 days.

(21) Appl. No.: 13/495,910

(22) Filed: Jun. 13, 2012

(65) Prior Publication Data

US 2013/0011254 A1 Jan. 10, 2013

Related U.S. Application Data

(60) Provisional application No. 61/497,422, filed on Jun. 15, 2011.

(51) Int. Cl.

| | |
|---|---|
| ***F04D 29/42*** | (2006.01) |
| ***F04D 25/08*** | (2006.01) |
| ***F04D 29/44*** | (2006.01) |
| ***F04D 29/08*** | (2006.01) |

(52) U.S. Cl.

CPC ..... *F04D 25/08* (2013.01); *F04D 29/083* (2013.01); *F04D 29/4226* (2013.01); *F04D 29/444* (2013.01); *F05D 2240/128* (2013.01)

(58) Field of Classification Search

CPC . F04D 29/4226; F04D 29/444; F04D 25/088; F04D 29/216; F04D 29/281; F04D 29/2812; F05D 2240/12; F05D 2240/128

USPC ..... 415/206, 211.2

See application file for complete search history.

(56) References Cited

U.S. PATENT DOCUMENTS

| | | | |
|---|---|---|---|
| 917,206 | A | 4/1909 | Watts |
| 1,858,067 | A | 5/1932 | Warren |
| 1,877,347 | A | 9/1932 | McMurdie |
| 1,926,795 | A | 9/1933 | Sassenberg |
| 2,016,778 | A | 10/1935 | Hall et al. |
| 2,189,008 | A | 2/1940 | Kurth |
| 2,189,502 | A | 2/1940 | Johnston |
| 2,232,573 | A | 2/1941 | Teves |
| 2,258,731 | A | 10/1941 | Blumenthal |
| 2,359,021 | A | 9/1944 | Campbell et al. |

(Continued)

FOREIGN PATENT DOCUMENTS

| | | |
|---|---|---|
| CN | 1426729 | 7/2003 |
| CN | 10 1592328 | 12/2009 |

(Continued)

OTHER PUBLICATIONS

Official Communication in Australian Application No. 2005227197, dated Nov. 23, 2009, in 3 pages.

(Continued)

*Primary Examiner* — Ninh H Nguyen

(74) *Attorney, Agent, or Firm* — Knobbe Martens Olson & Bear LLP

(57) ABSTRACT

An air moving device includes a housing member, a rotary fan assembly, and a nozzle, the housing including a plurality of air vents. The air moving device further includes at least one anti-drip structure in the form of a peripheral lip member for inhibiting water from entering the air moving device. The air moving device further includes a baffle member that acts to redirect a volume of air that enters through the plurality of air vents.

20 Claims, 9 Drawing Sheets

(56) References Cited

U.S. PATENT DOCUMENTS

| | | | | |
|---|---|---|---|---|
| 2,366,773 | A | | 1/1945 | Eklund et al. |
| 2,371,821 | A | | 3/1945 | Havis |
| D152,397 | S | | 1/1949 | Damond |
| 2,513,463 | A | | 7/1950 | Eklund et al. |
| 2,524,974 | A | | 10/1950 | Hickmott |
| 2,632,375 | A | | 3/1953 | Stair et al. |
| 2,658,719 | A | | 11/1953 | Johanson |
| 2,830,523 | A | | 4/1958 | Vehige |
| 2,982,198 | A | * | 5/1961 | Mohrman ..... 454/356 |
| 3,012,494 | A | | 12/1961 | Drummond |
| 3,036,509 | A | | 5/1962 | Babbitt |
| 3,068,341 | A | | 12/1962 | Ortiz et al. |
| D195,287 | S | | 5/1963 | Downing |
| 3,099,949 | A | | 8/1963 | Davidson |
| 3,165,294 | A | | 1/1965 | Anderson |
| 3,188,007 | A | * | 6/1965 | Myklebust ..... 239/215 |
| 3,212,425 | A | | 10/1965 | Lindner et al. |
| 3,246,699 | A | | 4/1966 | Jocz |
| 3,300,123 | A | | 1/1967 | Freyholdt et al. |
| 3,320,869 | A | | 5/1967 | Schach |
| 3,364,839 | A | | 1/1968 | Sweeney et al. |
| 3,382,791 | A | * | 5/1968 | Henry-Biabaud ..... 454/154 |
| 3,413,905 | A | | 12/1968 | Johnson |
| 3,524,399 | A | | 8/1970 | Bohanon |
| 3,584,968 | A | | 6/1971 | Keith |
| 3,601,184 | A | * | 8/1971 | Hauville ..... 165/125 |
| 3,690,244 | A | | 9/1972 | Kallel et al. |
| 3,699,872 | A | | 10/1972 | Kruger |
| 3,765,317 | A | | 10/1973 | Lowe |
| 3,785,271 | A | | 1/1974 | Joy |
| 3,827,342 | A | | 8/1974 | Hughes |
| 3,835,759 | A | | 9/1974 | Lloyd |
| 3,876,331 | A | | 4/1975 | DenHerder et al. |
| 3,927,300 | A | | 12/1975 | Wada et al. |
| 3,932,054 | A | | 1/1976 | McKelvey |
| 3,934,494 | A | | 1/1976 | Butler |
| 3,967,927 | A | | 7/1976 | Patterson |
| 3,973,479 | A | | 8/1976 | Whiteley |
| 3,988,973 | A | | 11/1976 | Honmann |
| 4,006,673 | A | | 2/1977 | Meyer et al. |
| 4,152,973 | A | | 5/1979 | Peterson |
| 4,185,545 | A | | 1/1980 | Rusth et al. |
| D256,273 | S | | 8/1980 | Townsend et al. |
| 4,261,255 | A | | 4/1981 | Anderson et al. |
| 4,321,659 | A | | 3/1982 | Wheeler |
| 4,344,112 | A | | 8/1982 | Brown |
| 4,396,352 | A | | 8/1983 | Pearce |
| 4,473,000 | A | | 9/1984 | Perkins |
| 4,512,242 | A | | 4/1985 | Bohanon, Sr. |
| 4,515,538 | A | | 5/1985 | Shih |
| 4,522,255 | A | | 6/1985 | Baker |
| 4,524,679 | A | | 6/1985 | Lyons |
| 4,546,420 | A | | 10/1985 | Wheeler et al. |
| 4,548,548 | A | | 10/1985 | Gray, III |
| 4,550,649 | A | | 11/1985 | Zambolin |
| 4,630,182 | A | | 12/1986 | Moroi et al. |
| 4,662,912 | A | | 5/1987 | Perkins |
| 4,678,410 | A | | 7/1987 | Kullen |
| 4,681,024 | A | | 7/1987 | Ivey |
| 4,715,784 | A | | 12/1987 | Mosiewicz |
| 4,716,818 | A | | 1/1988 | Brown |
| 4,730,551 | A | | 3/1988 | Peludat |
| 4,790,863 | A | | 12/1988 | Nobiraki et al. |
| 4,794,851 | A | | 1/1989 | Kurrle |
| 4,848,669 | A | | 7/1989 | George |
| 4,850,265 | A | | 7/1989 | Raisanen |
| 4,890,547 | A | | 1/1990 | Wagner et al. |
| 4,895,065 | A | | 1/1990 | Lamparter |
| D308,416 | S | | 6/1990 | Brumbach |
| 4,930,987 | A | | 6/1990 | Stahl |
| 4,971,143 | A | | 11/1990 | Hogan |
| 4,973,016 | A | | 11/1990 | Hertenstein |
| 5,000,081 | A | | 3/1991 | Gilmer |
| 5,021,932 | A | | 6/1991 | Ivey |
| 5,033,711 | A | | 7/1991 | Gregorich et al. |
| 5,042,366 | A | | 8/1991 | Panetski et al. |
| 5,078,574 | A | | 1/1992 | Olsen |
| D325,628 | S | | 4/1992 | Cho |
| 5,107,755 | A | | 4/1992 | Leban et al. |
| 5,121,675 | A | | 6/1992 | Muller et al. |
| 5,127,876 | A | | 7/1992 | Howe et al. |
| 5,152,606 | A | | 10/1992 | Borraccia et al. |
| 5,156,568 | A | | 10/1992 | Ricci |
| 5,191,618 | A | | 3/1993 | Hisey |
| D340,765 | S | | 10/1993 | Joss et al. |
| 5,328,152 | A | | 7/1994 | Castle |
| 5,358,443 | A | | 10/1994 | Mitchell et al. |
| 5,399,119 | A | | 3/1995 | Birk et al. |
| 5,429,481 | A | | 7/1995 | Liu |
| 5,443,625 | A | | 8/1995 | Schaffhausen |
| 5,458,505 | A | | 10/1995 | Prager |
| 5,462,484 | A | | 10/1995 | Jung et al. |
| 5,511,942 | A | | 4/1996 | Meier |
| 5,513,953 | A | | 5/1996 | Hansen |
| 5,520,515 | A | | 5/1996 | Bailey et al. |
| 5,547,343 | A | | 8/1996 | Jané et al. |
| 5,561,952 | A | | 10/1996 | Damron |
| 5,569,019 | A | | 10/1996 | Katariya et al. |
| 5,584,656 | A | | 12/1996 | Rose |
| 5,595,068 | A | | 1/1997 | Amr |
| 5,613,833 | A | | 3/1997 | Wolfe et al. |
| 5,658,196 | A | | 8/1997 | Swaim |
| 5,664,872 | A | | 9/1997 | Spearman et al. |
| 5,709,458 | A | | 1/1998 | Metz |
| 5,725,356 | A | | 3/1998 | Carter |
| 5,791,985 | A | | 8/1998 | Schiedegger et al. |
| 5,918,972 | A | | 7/1999 | Van Belle |
| 5,934,783 | A | | 8/1999 | Yoshikawa |
| D414,550 | S | | 9/1999 | Bloom |
| 5,947,816 | A | | 9/1999 | Schiedegger et al. |
| 5,967,891 | A | | 10/1999 | Riley et al. |
| 5,997,253 | A | | 12/1999 | Fechan |
| 6,004,097 | A | | 12/1999 | Wark et al. |
| 6,068,385 | A | | 5/2000 | Hsieh |
| 6,095,671 | A | | 8/2000 | Hutain |
| 6,109,874 | A | | 8/2000 | Steiner |
| 6,145,798 | A | | 11/2000 | Janisse et al. |
| 6,149,513 | A | | 11/2000 | Lyu |
| 6,155,782 | A | | 12/2000 | Hsu |
| 6,168,517 | B1 | | 1/2001 | Cook |
| 6,183,203 | B1 | | 2/2001 | Grintz |
| 6,192,702 | B1 | | 2/2001 | Shimogori |
| 6,196,915 | B1 | | 3/2001 | Schiedegger et al. |
| 6,352,473 | B1 | | 3/2002 | Clark |
| 6,360,816 | B1 | | 3/2002 | Wagner |
| 6,361,428 | B1 | | 3/2002 | Tosconi et al. |
| 6,361,431 | B1 | | 3/2002 | Kawano |
| 6,364,760 | B1 | | 4/2002 | Rooney |
| 6,383,072 | B2 | | 5/2002 | Schiedegger et al. |
| 6,384,494 | B1 | | 5/2002 | Avidano et al. |
| 6,386,970 | B1 | | 5/2002 | Vernier, II et al. |
| 6,386,972 | B1 | | 5/2002 | Schiedegger et al. |
| 6,435,964 | B1 | | 8/2002 | Chang |
| 6,458,028 | B2 | | 10/2002 | Snyder |
| 6,484,524 | B1 | | 11/2002 | Ulanov |
| 6,551,185 | B1 | | 4/2003 | Miyake et al. |
| 6,575,011 | B1 | | 6/2003 | Busby et al. |
| 6,581,974 | B1 | | 6/2003 | Ragner et al. |
| 6,582,291 | B2 | | 6/2003 | Clark |
| 6,592,328 | B1 | | 7/2003 | Cahill |
| 6,595,747 | B2 | | 7/2003 | Bos |
| 6,626,003 | B1 | | 9/2003 | Kortüm et al. |
| 6,626,636 | B2 | | 9/2003 | Bohn |
| 6,648,752 | B2 | | 11/2003 | Vernier, II et al. |
| 6,679,433 | B2 | | 1/2004 | Gordon et al. |
| 6,682,308 | B1 | | 1/2004 | Fei et al. |
| 6,767,281 | B2 | | 7/2004 | McKee |
| 6,783,578 | B2 | | 8/2004 | Tillman, Jr. |
| 6,804,627 | B1 | | 10/2004 | Marokhovsky et al. |
| 6,812,849 | B1 | | 11/2004 | Ancel |
| 6,886,270 | B2 | | 5/2005 | Gilmer |
| 6,916,240 | B1 | | 7/2005 | Morton |
| 6,938,631 | B2 | | 9/2005 | Gridley |
| 6,951,081 | B2 | | 10/2005 | Bonshor |

(56) References Cited

U.S. PATENT DOCUMENTS

| | | | | |
|---|---|---|---|---|
| 6,966,830 | B2 | 11/2005 | Hurlstone et al. | |
| 6,974,381 | B1 | 12/2005 | Walker et al. | |
| D514,688 | S | 2/2006 | Avedon | |
| 7,011,578 | B1 | 3/2006 | Core | |
| 7,044,849 | B2 | 5/2006 | Dippel | |
| 7,048,499 | B2 | 5/2006 | Mathson et al. | |
| 7,056,092 | B2 | 6/2006 | Stahl | |
| 7,101,064 | B2 | 9/2006 | Ancel | |
| 7,152,425 | B2 * | 12/2006 | Han et al. | 62/419 |
| 7,166,023 | B2 | 1/2007 | Haigh et al. | |
| 7,175,309 | B2 | 2/2007 | Craw et al. | |
| 7,185,504 | B2 | 3/2007 | Kasai et al. | |
| 7,201,110 | B1 | 4/2007 | Pawlak | |
| 7,201,650 | B2 | 4/2007 | Demerath et al. | |
| 7,214,035 | B2 | 5/2007 | Bussieres et al. | |
| 7,288,023 | B2 | 10/2007 | Leopold | |
| 7,320,636 | B2 | 1/2008 | Seliger et al. | |
| 7,374,408 | B2 | 5/2008 | Savage et al. | |
| 7,381,129 | B2 | 6/2008 | Avedon | |
| 7,467,931 | B2 | 12/2008 | O'Toole | |
| 7,497,773 | B1 | 3/2009 | Schmidt | |
| 7,516,578 | B2 | 4/2009 | Bonshor | |
| 7,544,124 | B2 | 6/2009 | Polston | |
| 7,549,258 | B2 | 6/2009 | Lajewski | |
| 7,566,034 | B2 | 7/2009 | Bonshor | |
| 7,607,935 | B2 | 10/2009 | Dahl | |
| 7,610,726 | B2 | 11/2009 | Lajewski | |
| 7,645,188 | B1 | 1/2010 | Peerbolt | |
| 7,651,390 | B1 | 1/2010 | Profeta et al. | |
| 7,677,964 | B1 | 3/2010 | Bucher et al. | |
| 7,708,625 | B2 | 5/2010 | Leseman et al. | |
| 7,752,814 | B2 | 7/2010 | Bonshor | |
| 7,774,999 | B2 | 8/2010 | McKee | |
| 7,780,510 | B2 | 8/2010 | Polston | |
| D631,148 | S | 1/2011 | Benton et al. | |
| 7,901,278 | B2 | 3/2011 | O'Hagin | |
| 7,930,858 | B2 | 4/2011 | Lajewski | |
| D672,863 | S | 12/2012 | Romero Carreras | |
| D681,184 | S | 4/2013 | Romero Carreras | |
| 8,616,842 | B2 | 12/2013 | Avedon | |
| D698,916 | S | 2/2014 | Avedon | |
| 2002/0045420 | A1 | 4/2002 | Taillon | |
| 2002/0137454 | A1 | 9/2002 | Baker | |
| 2004/0050077 | A1 | 3/2004 | Kasai et al. | |
| 2004/0052641 | A1 | 3/2004 | Chen | |
| 2004/0240214 | A1 | 12/2004 | Whitlow et al. | |
| 2005/0092888 | A1 | 5/2005 | Gonce | |
| 2005/0159101 | A1 | 7/2005 | Hrdina et al. | |
| 2005/0202776 | A1 | 9/2005 | Avedon | |
| 2006/0276123 | A1 | 12/2006 | Sanagi et al. | |
| 2007/0213003 | A1 | 9/2007 | Railkar et al. | |
| 2007/0297906 | A1 | 12/2007 | Wu | |
| 2008/0188175 | A1 | 8/2008 | Wilkins | |
| 2008/0227381 | A1 | 9/2008 | Avedon | |
| 2009/0170421 | A1 | 7/2009 | Adrian et al. | |
| 2009/0262550 | A1 | 10/2009 | Inoue | |
| 2010/0009621 | A1 | 1/2010 | Hsieh | |
| 2010/0052495 | A1 | 3/2010 | Liu et al. | |
| 2010/0176706 | A1 | 7/2010 | Fu et al. | |
| 2010/0192611 | A1 | 8/2010 | Yamaguchi et al. | |
| 2010/0266400 | A1 | 10/2010 | Avedon | |
| 2011/0037368 | A1 | 2/2011 | Huang | |
| 2011/0057551 | A1 | 3/2011 | Lee et al. | |
| 2011/0057552 | A1 | 3/2011 | Weaver | |
| 2011/0080096 | A1 | 4/2011 | Dudik et al. | |
| 2011/0084586 | A1 | 4/2011 | Lain et al. | |
| 2011/0133622 | A1 | 6/2011 | Mo et al. | |
| 2011/0140588 | A1 | 6/2011 | Chen | |
| 2012/0195749 | A1 | 8/2012 | Avedon | |
| 2013/0023195 | A1 | 1/2013 | Avedon | |
| 2013/0027950 | A1 | 1/2013 | Avedon | |

FOREIGN PATENT DOCUMENTS

| | | | |
|---|---|---|---|
| DE | 44 13 542 | | 10/1995 |
| DE | 10 2008 044874 | | 3/2010 |
| EP | 0 037 958 | | 10/1981 |
| EP | 0 212 749 | | 3/1987 |
| EP | 2 248 692 | | 11/2010 |
| FR | 0 715 101 | | 11/1931 |
| FR | 2 784 423 | | 4/2000 |
| GB | 824390 | A * | 11/1959 |
| GB | 0 981 188 | | 1/1965 |
| GB | 2 344 619 | | 6/2000 |
| GB | 2 468 504 | | 9/2010 |
| JP | 55-032965 | | 3/1980 |
| JP | 61-502267 | | 10/1986 |
| JP | 07-167097 | | 7/1995 |
| JP | 07-253231 | | 10/1995 |
| JP | 08-219939 | | 8/1996 |
| JP | 2001-193979 | | 7/2001 |
| JP | 2002-349489 | | 12/2002 |
| JP | 2006-350237 | | 12/2006 |
| KR | 2003-0025428 | | 3/2003 |
| RU | 2400254 | C2 | 9/2010 |
| WO | WO 01/34983 | | 5/2001 |
| WO | WO 2005/091896 | | 10/2005 |
| WO | WO 2006/078102 | | 7/2006 |
| WO | WO 2008/062319 | | 5/2008 |
| WO | WO 2010/046536 | A1 | 4/2010 |
| WO | WO 2010/114702 | | 10/2010 |
| WO | WO 2011/067430 | | 6/2011 |
| WO | WO 2012/174155 | | 12/2012 |
| WO | WO 2012/174156 | | 12/2012 |

OTHER PUBLICATIONS

Official Communication in Australian Application No. 2005227197, dated Dec. 20, 2010, in 2 pages.

Official Communication in Australian Application No. 2005227197, dated Mar. 30, 2011 in 2 pages.

Official Communication in Australian Application No. 2011253799, dated Sep. 17, 2012, in 4 pages.

Official Communication in Canadian Application No. 2,559,610, dated Aug. 26, 2011 in 3 pages.

European Search Report for Application No. EP 05714125.1, dated May 4, 2009 in 5 pages.

Official Communication in European Application No. 05714125.1, dated Mar. 11, 2010, in 7 pages.

Official Communication in European Application No. 05714125.1, dated Jul. 4, 2012, in 5 pages.

European Search Report for Application No. EP 12160654.5, dated Aug. 24, 2012 in 6 pages.

Official Communication in Japanese Application No. 2007-503918, dated Oct. 26, 2010 in 3 pages.

Official Communication in Japanese Application No. 2007-503918, dated May 18, 2011 in 2 pages.

Official Communication in Korean Application No. 10-2006-7021292, dated Mar. 16, 2012, in 12 pages.

Official Communication in New Zealand Application No. 549851, dated Mar. 10, 2009, in 3 pages.

Official Communication in New Zealand Application No. 549851, dated Sep. 22, 2010, in 2 pages.

Official Communication in Polish Application No. P-382705, dated Nov. 10, 2011, in 1 page.

International Search Report and Written Opinion in International Application No. PCT/US2010/027546, dated May 12, 2010 in 7 pages.

International Search Report and Written Opinion in International Application No. PCT/US2012/042309, dated Oct. 24, 2012 in 12 pages.

International Search Report for Application No. PCT/US2012/042308 mailed Aug. 24, 2012 in 13 pages.

Official Communication in Australian Application No. 2011253799, dated Nov. 23, 2012.

Official Communication in Korean Application No. 10-2006-7021292, dated Dec. 27, 2012 in 4 pages.

(56) References Cited

OTHER PUBLICATIONS

Official Communication in Polish Application No. P-382705, dated Dec. 17, 2012, in 2 pages.

International Preliminary Report on Patentability in International Application No. PCT/US2012/042309, dated Dec. 3, 2013.

International Preliminary Report on Patentability in International Application No. PCT/US2012/042308, dated Dec. 17, 2013.

* cited by examiner

COLUMNAR AIR MOVING DEVICES, SYSTEMS AND METHODS

CROSS-REFERENCE TO RELATED APPLICATIONS

This application claims benefit under 35 U.S.C. §119(e) to U.S. Provisional Patent Application No. 61/497,422, filed Jun. 15, 2011, which is incorporated in its entirety by reference herein.

This application is related to U.S. Provisional Patent Application No. 61/497,446, entitled Columnar Air Moving Devices, Systems and Methods, filed Jun. 15, 2011, and to U.S. Provisional Patent Application No. 61/497,448, entitled Columnar Air Moving Devices, Systems and Methods, filed Jun. 15, 2011, each of which is incorporated in its entirety by reference herein. This application is also related to U.S. patent application Ser. No. 12/130,909, filed May 30, 2008, and to U.S. patent application Ser. No. 12/724,799, filed Mar. 16, 2010, each of which is incorporated in its entirety by reference herein.

BACKGROUND OF THE INVENTIONS

1. Field of the Inventions

The present application relates generally to systems, devices and methods for moving air that are particularly suitable for creating air temperature de-stratification within a room, building, or other structure.

2. Description of the Related Art

The rise of warm air and the sinking of cold air can create significant variation in air temperatures between the ceiling and floor of buildings with any sort of heating, ventilation and air conditioning systems. Air temperature stratification is particularly problematic in all spaces with any ceilings such as warehouses, gymnasiums, offices, auditoriums, hangers, commercial buildings, residences, agricultural buildings, and other structures, and significantly increases heating and air conditioning costs. Structures with both low and high ceiling rooms can often have stagnant or dead air, as well, which can further lead to air temperature stratification problems and propagation of mold and mildew potentially increasing health problems of humans, animals, and plants.

One proposed solution to air temperature stratification is a ceiling fan. Ceiling fans are relatively large rotary fans, with a plurality of blades, mounted near the ceiling. The blades of a ceiling fan have a flat or airfoil shape. The blades have a lift component that pushes air upwards or downwards, depending on the direction of rotation, and a rotational component that pushes the air tangentially. The rotational component causes tangential or centrifugal flow so that the air being pushed diverges or spreads out. Conventional ceiling fans are generally ineffective as an air de-stratification device in relatively high ceiling rooms because the air pushed by conventional ceiling fans is not maintained in a columnar pattern from the ceiling to the floor, and often disperses or diffuses well above the floor of the space.

Another proposed solution to air temperature stratification is a fan connected to a vertical tube that extends substantially from the ceiling to the floor. The fan can be mounted near the ceiling, near the floor or in between. This type of device can push cooler air up from the floor to the ceiling or warmer air down from the ceiling to the floor. Such devices, when located away from the walls in an open space in a building, interfere with floor space use and are not aesthetically pleasing. When confined to locations only along the walls of an open space, such devices may not effectively circulate air near the center of the open space. Examples of fans connected to vertical tubes are disclosed in U.S. Pat. No. 3,827,342 to Hughes, and U.S. Pat. No. 3,973,479 to Whiteley.

A more practical solution is a device, for example, with a rotary fan that minimizes a rotary component of an air flow while maximizing axial or columnar air flow quantity and velocity, thereby providing a column of air that flows from the high ceiling to the floor in a columnar pattern with minimal lateral dispersion without a physical transporting tube. Examples of this type of device are described in U.S. patent application Ser. No. 12/130,909, filed May 30, 2008, and U.S. patent application Ser. No. 12/724,799, filed Mar. 16, 2010, each of which is incorporated in its entirety by reference herein.

SUMMARY OF THE INVENTION

An aspect of at least one of the embodiments disclosed herein includes the realization that columnar air moving devices can be beneficial in any agricultural buildings or other environments where it is common for water, steam, or other material to be sprayed within the building for cleaning or irrigation purposes. For example, the agricultural business commonly uses buildings that are used to house animals, plants, or other applications. Within these buildings, it can be beneficial to have air de-stratification devices that hang from the ceiling, and circulate and de-stratify the air inside. However, these buildings are often cleaned (e.g. five to six times a year between breeding cycles) with water or steam hoses. During such cleaning, water is often directed up towards the ceiling. Devices which are hanging from the ceiling can be susceptible to damage from the spraying, as well as from any water or other debris that may find its way inside the device.

Therefore, it would be advantageous to have an air de-stratification device that is designed to inhibit introduction of water within the device. Such a device can have features that make it generally an enclosed and/or drip-proof device that does not have to be replaced each time the inside of the building is sprayed and cleaned.

Thus, in accordance with at least one embodiment described herein, a columnar air moving device can comprise a housing member forming an interior space within the air moving device, the housing member comprising a plurality of air vents for directing a volume of air into the interior space, a lip member integrally formed with or attached to the housing member, the lip member forming an outer peripheral edge of the air moving device, the lip member flared outwardly away from the housing member so as to form a drip edge along the housing member, a rotary fan assembly mounted within the interior space, the rotary fan assembly comprising an impeller and a plurality of blades for further directing the volume of air, and a nozzle communicating with and extending downwardly from the rotary fan assembly, the nozzle comprising a structure for further directing the volume of air out of the air moving device.

In accordance with at least another embodiment, a columnar air moving device can comprise a housing member forming an interior space within the air moving device, the housing member comprising a plurality of air vents for directing a volume of air into the interior space of the air moving device, a baffle member disposed at least partially within the interior space of the air moving device, the baffle member attached to the housing member and configured to redirect the volume air within the interior space, a rotary fan assembly mounted in the interior space, the rotary fan assembly comprising an impeller and a plurality of blades, the rotary fan assembly configured to further redirect the volume of air within the interior space, and a nozzle communicating with and extending downwardly from the rotary fan assembly, the nozzle comprising a structure for further directing the volume of air out of the air moving device.

BRIEF DESCRIPTION OF THE DRAWINGS

These and other features and advantages of the present embodiments will become more apparent upon reading the following detailed description and with reference to the accompanying drawings of the embodiments, in which.

DETAILED DESCRIPTION OF THE PREFERRED EMBODIMENTS

Figure 1:
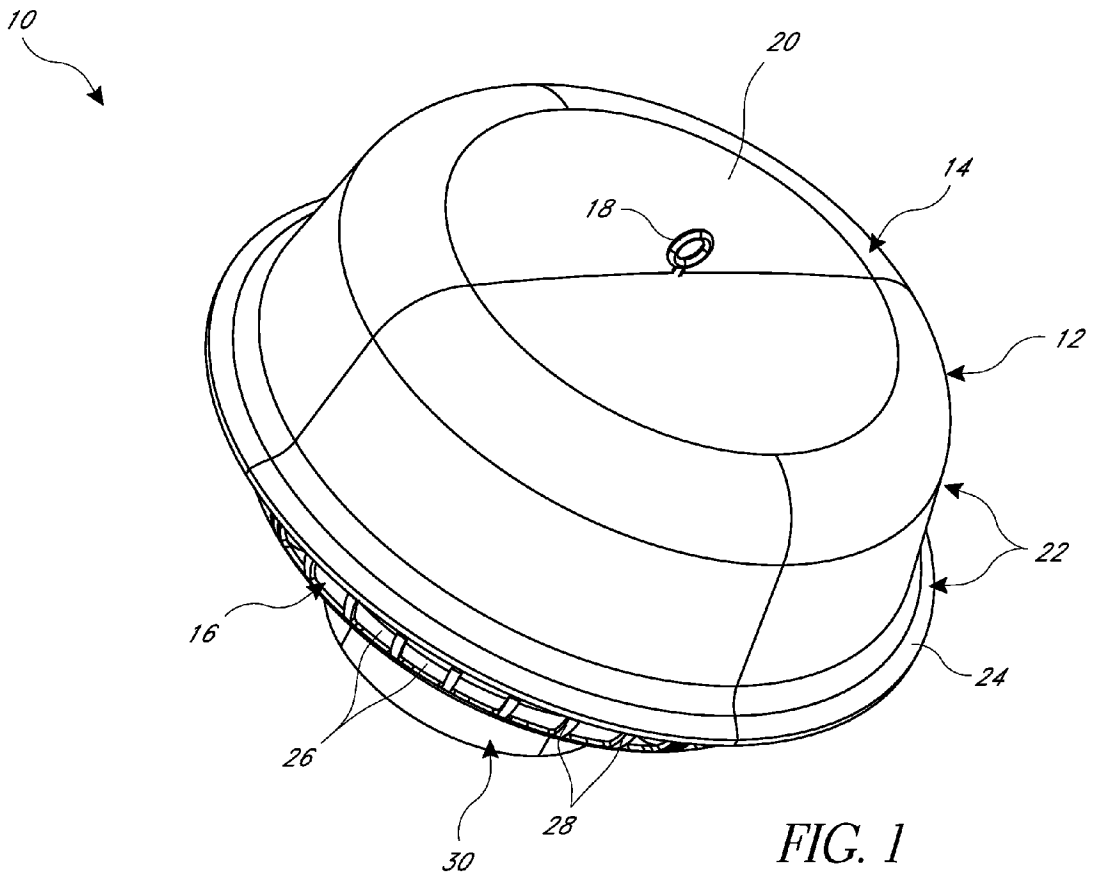
FIG. 1 is a top perspective view of an air moving device in accordance with an embodiment.

With reference to FIGS. 1-4, an air moving device 10 can comprise a housing member 12. The housing member 12 can form an outer shell of the air moving device 10, and can at least partially enclose an interior space within the air moving device 10. The housing member 12 can be formed from one or more sections. For example, the housing member 12 can comprise an upper housing section 14, and a lower housing section 16. In some embodiments the upper and lower housing sections 14, 16 can be attached to one other through use of fasteners, adhesive, or other structure. In some embodiments the upper housing section 14 is larger than the lower housing section 16. In some embodiments, the upper housing section 14 can comprise a first outer diameter, and the lower housing section 16 can comprise a second outer diameter, the first outer diameter being greater than the second outer diameter. In some embodiments, the upper housing section 14 and lower housing section 16 can be integrally formed as a single piece.

The housing member 12 can include a support member 18. The support member 18 can be used to support the weight of the air moving device 10, and/or to attach the air moving device 10 to another structure. In some embodiments, the support member 18 can comprise a ring-shaped structure (e.g. an eye-bolt). The support member 18 can extend from a top surface 20 of the housing member 12. The support member 18 can be used, for example, to hang the air moving device 10 from a ceiling structure within a building, for example with wire, string, rope, or other device(s). In some embodiments, the housing member 12 can comprise multiple support members 18.

With continued reference to FIGS. 1-4, the housing member 12 can comprise at least one exterior anti-drip structure 22. For example, the exterior anti-drip structure 22 can comprise a lip member 24 along the housing member 12 that is formed integrally with or attached to the housing member 12. In some embodiments, the lip member 24 can extend around a circumference of the air moving device 10. The lip member 24 can form an outer peripheral edge of the air moving device 10. The lip member 24 can extend generally downwardly, at an angle, so as to direct water away from the housing member 12 and the air moving device 10. In some embodiments, the lip member 24 can be angled greater than 10 degrees downwardly relative to a horizontal plane extending through the air moving device 10. In some embodiments, the lip member 24 can be angled greater than 20 degrees downwardly relative to a horizontal plane extending through the air moving device. In some embodiments, the lip member 24 can be angled greater than 30 degrees downwardly relative to a horizontal plane extending through the air moving device. In some embodiments, the lip member 24 can comprise an outwardly flared member attached to or integrally formed with the housing member 12. The outwardly flared member can form a drip edge along the housing member 12. In some embodiments, the lip member 24 can be configured to direct water away from the interior space of the air moving device 10. In some embodiments, the lip member 24 can form part of the upper housing member 14. In some embodiments, the lip member 24 can comprise an outwardly flared lower portion of the upper housing member 14.

With continued reference to FIGS. 1-4, the exterior anti-drip structure 22 can alternatively, or additionally, comprise an upper housing section 14 that is in the shape of a solid dome. The dome shape of the upper housing section 14 can be configured to direct water away from the housing member 12 and the air moving device 10. The dome shape of the upper housing section 14 can be configured to direct water away from the interior space of the air moving device 10, and away, for example, from any electrical components within the interior space of the air moving device 10.

In some embodiments the exterior anti-drip structure 22 can comprise both a dome-shaped upper housing section 14, as well as a lip member 24. The combination of the dome-shaped upper housing section 14, as well as the lip member 24, can be used to direct water away from the housing 12 and air moving device 10. The combination of the dome-shaped upper housing section 14, as well as the lip member 24, can be used to direct water away from the interior space of the air moving device 10.

With continued reference to FIGS. 1-4, the housing member 12 can comprise a at least one air vent 26. The air vent or vents 26 can be configured to direct a volume of air into the interior space of the air moving device 10. For example, the housing member 12 can comprise a plurality of air vents 26 in the lower housing section 16 that are spaced generally circumferentially around the air moving device. The plurality of air vents 26 can be spaced directly below the lip member 24, such that the lip member 24 extends outwardly over and above the plurality of air vents 26. In some embodiments, the air vents 26 can be separated by air vent guides 28. The air vents 26, and air vent guides 28, can be equally spaced apart from one another around the air moving device 10. In some embodiments, the air vent guides 28 can be smaller in width than the air vents 26.

With continued reference to FIGS. 1-4, the air moving device 10 can comprise a nozzle 30. The nozzle 30 can communicate with and extend downwardly from the housing member 12. The nozzle 30 can comprise a structure for directing a volume of air out of the air moving device 10. For example, the nozzle 30 can comprise a structure for directing a volume of air out of the air moving device 10 that has previously entered through the plurality of air vents 26. In some embodiments, the nozzle 30 is attached to the housing member 12.

Figure 5:
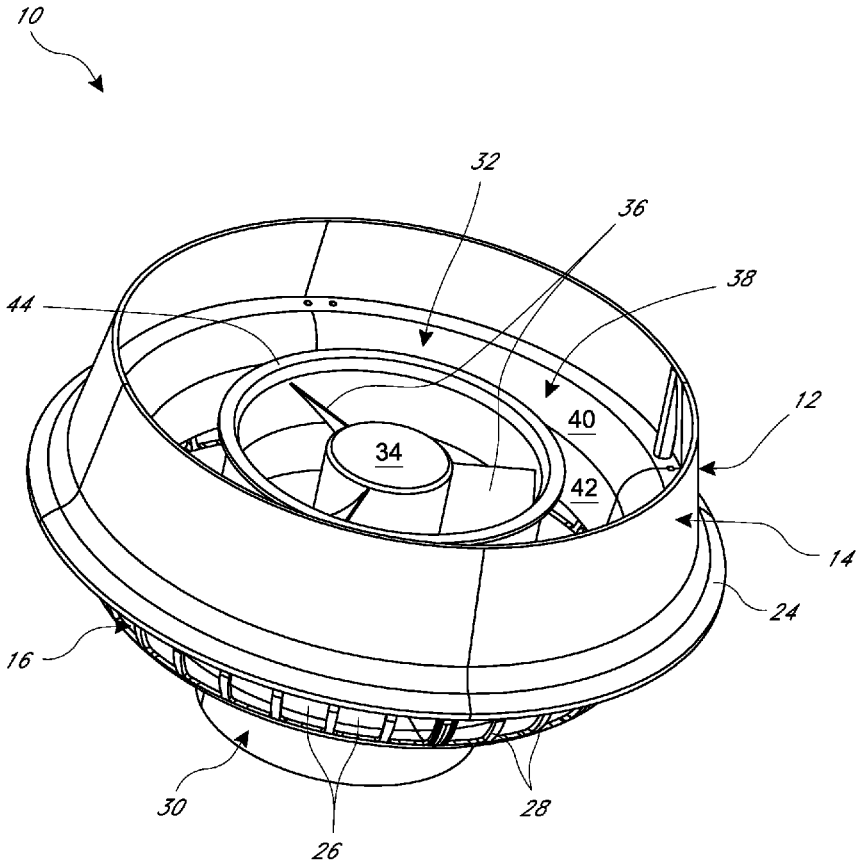
FIG. 5 is a perspective, partial view of the device of FIG. 1, taken along line 5-5 in FIG. 2.
Figure 6:
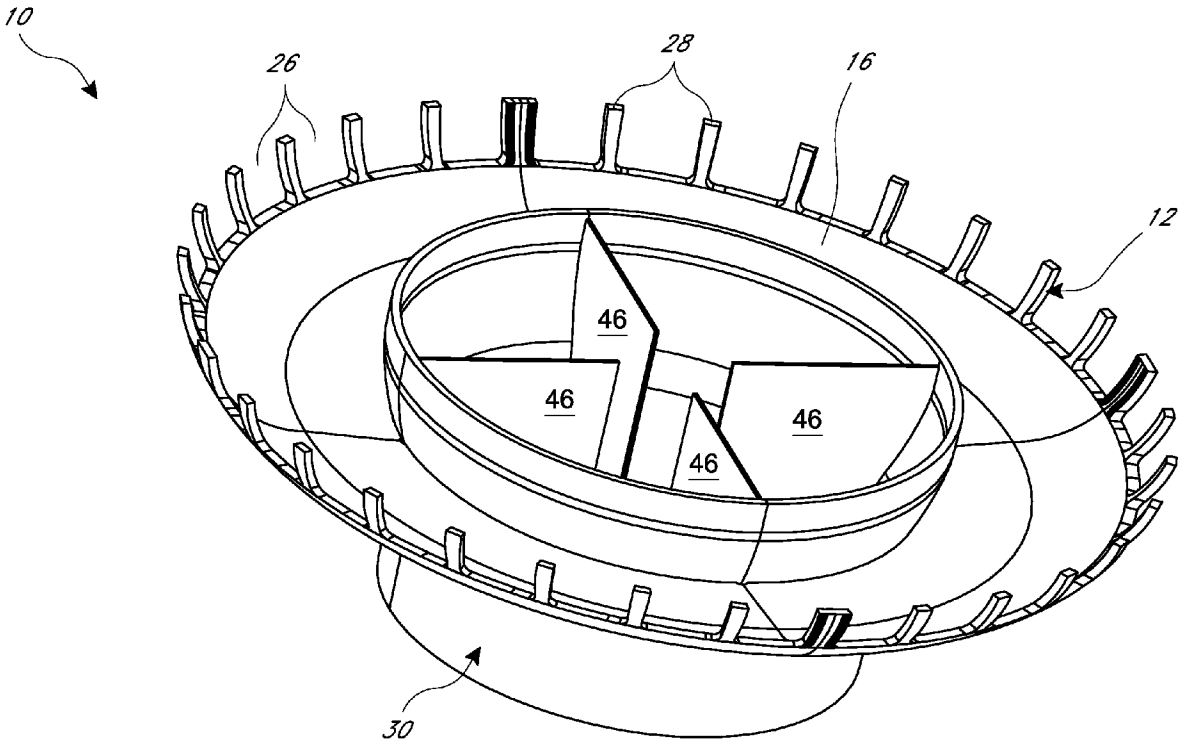
FIG. 6 is a perspective, partial view of the device of FIG. 1, taken along line 6-6 in FIG. 2.
Figure 7:
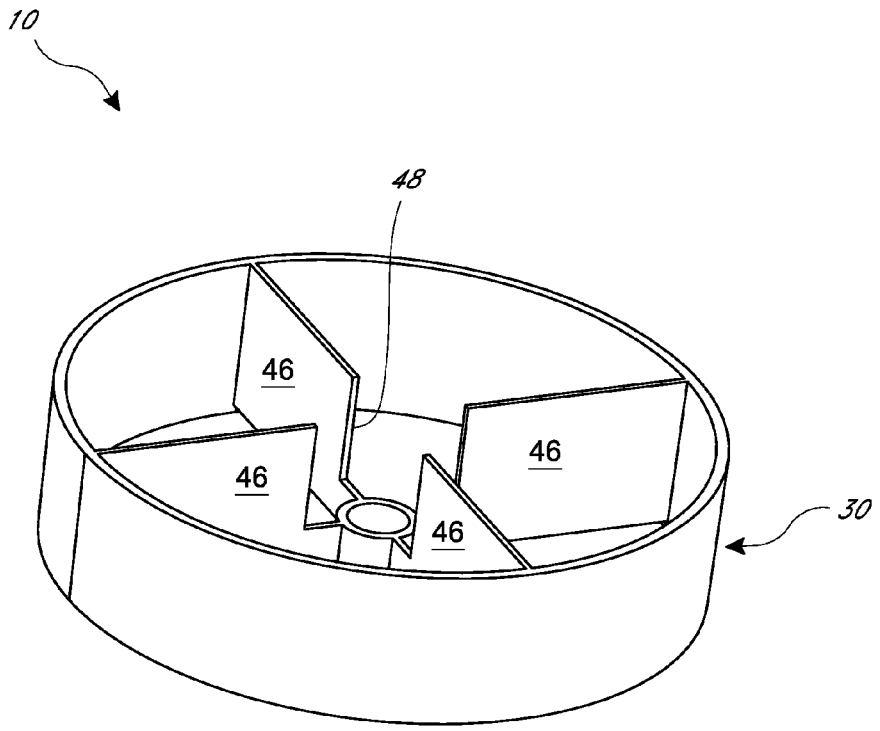
FIG. 7 a perspective, partial view of the device of FIG. 1, taken along line 7-7 in FIG. 2.
Figure 8:
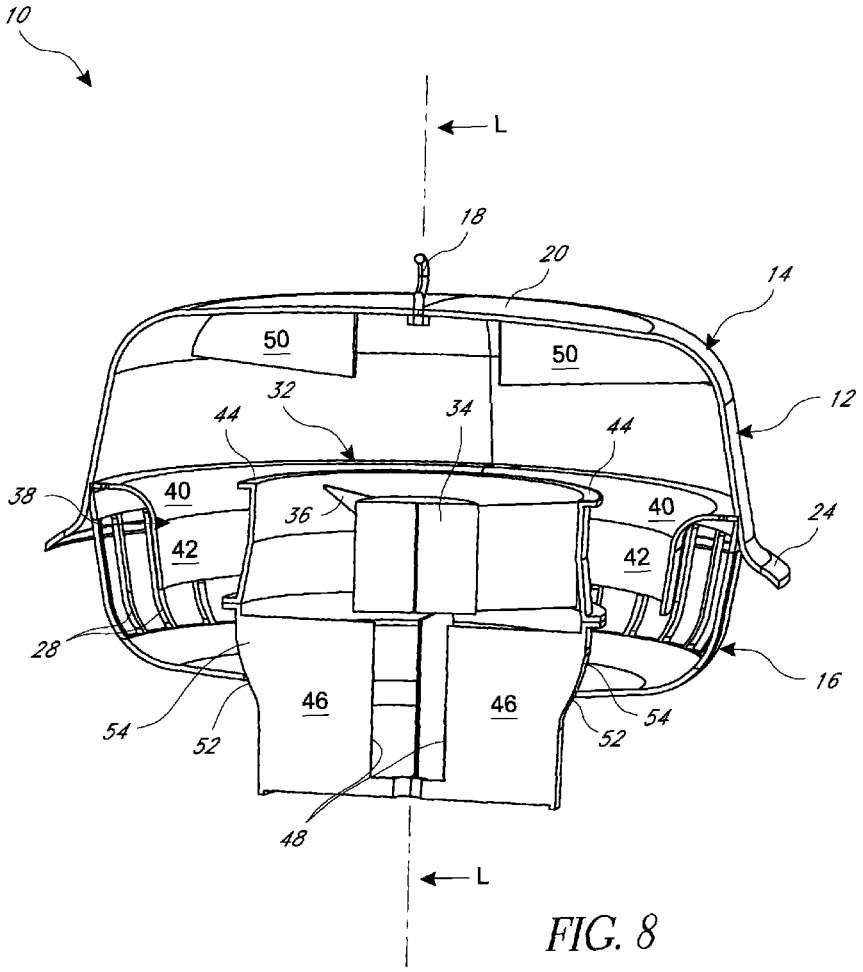
FIG. 8 is cross-sectional view of the device of FIG. 1, taken along line 8-8 in FIG. 2.

With reference to FIGS. 5 and 8, the air moving device 10 can comprise a rotary fan assembly 32 mounted within the interior space. The rotary fan assembly 32 can comprise an impeller 34 and a plurality of blades 36. The rotary fan assembly 32 can be configured to direct a volume of air that has entered through the plurality of air vents 26 downwardly into the nozzle 30. The rotary fan assembly 32 can push, or force, a volume of air downwardly within the interior space of the air moving device 10. The rotary fan assembly 32 can comprise a motor. The rotary fan assembly 32 can comprise at least one electrical component. The rotary fan assembly 32 can be mounted generally above the plurality of air vents 26, such that the volume of air entering the plurality of air vents 26 is required to travel upwardly within the interior space of the air moving device 10 before it can enter the rotary fan assembly 32. In some embodiments, the rotary fan assembly 32 can be mounted to the lower housing section 16. The nozzle 30 can communicate with and extend downwardly from the rotary fan assembly 32. In some embodiments, the nozzle 30 is attached to the rotary fan assembly 32.

Figure 9:
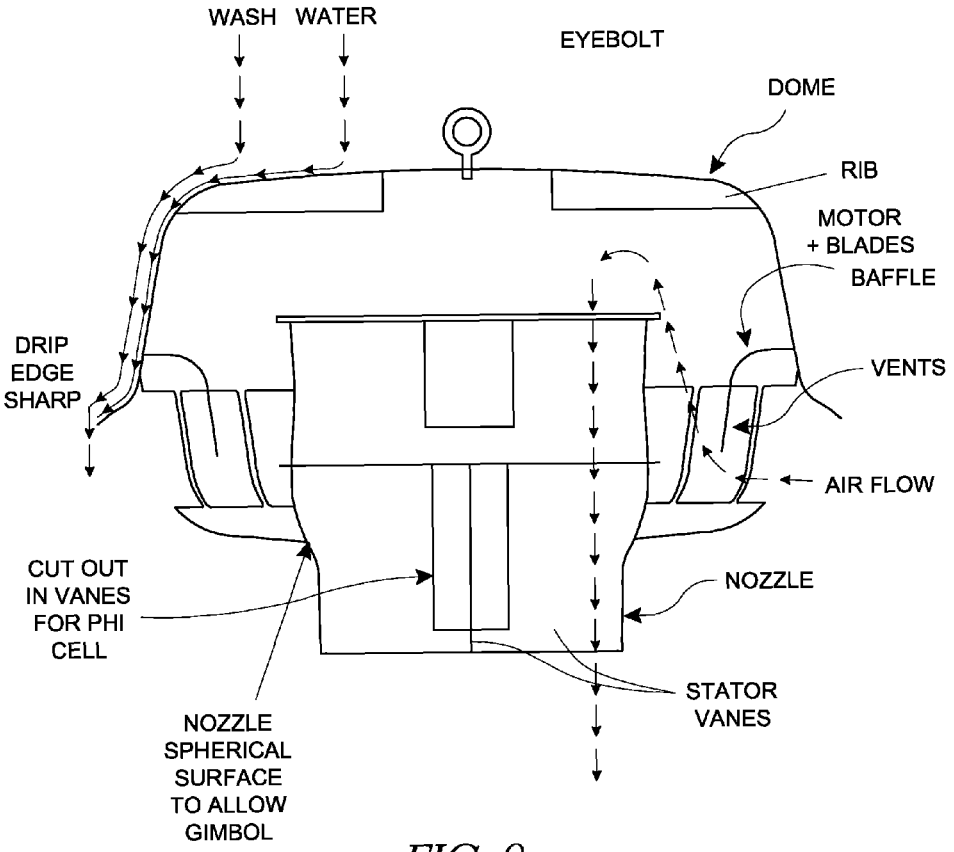
FIG. 9 is a schematic, cross-sectional view of the air moving device of FIG. 1.

With continued reference to FIGS. 5 and 8, as well as FIG. 9, the air moving device 10 can comprise a baffle member 38. The baffle member 38 can be positioned around an interior of the housing member 12. The baffle member 38 can comprise a structure that is configured to redirect a volume of air that enters through the plurality of air vents 26. For example, the baffle member 38 can comprise a generally curved structure having a first end 40 and a second end 42. The first end 40 can be attached to the housing member 12, and can extend generally inwardly into the interior space of the air moving device 10. The second end 42 can extend downwardly, such that it extends below an upper rim 44 of the rotary fan assembly 32. With reference to FIG. 9, which illustrates a schematic view of an embodiment of the air moving device 10, the baffle member 38 can be positioned within the interior space of the air moving device 10 such that it forces a volume of air entering through the plurality of air vents 26 to take non-linear path to the upper rim 44 of the rotary fan assembly 32, and down into the nozzle 30. The baffle member 38 can be positioned such that it forces a volume of air entering through the plurality of air vents to take a generally sinusoidal pathway to the upper rim 44 of the rotary fan assembly 32, and down into the nozzle 30. The baffle member 38 can be positioned such that it blocks a flow of a volume of air entering through the plurality of air vents 26. The baffle member 38 can be positioned such that it causes a volume of air entering through the plurality of air vents 26 to move downwardly, then back upwardly, before the volume of air is capable of moving back downwardly through the rotary fan assembly 32 and into the nozzle 30.

The advantage of having a baffle member 38 positioned in this manner is that it makes it difficult, if not impossible, for water or other debris to easily find its way up into the rotary fan assembly 32 via the plurality of air vents 26, thereby protecting the rotary fan assembly and areas of the interior space of the air moving device 10 from damage. For example, and as described above, it is often the case that in agricultural buildings, the ceilings and walls are sprayed with water or steam hoses. The water and debris carried by the water can damage a de-stratification device that is hanging from the ceiling. Therefore, to inhibit damage, the air moving device 10 can incorporate one or more exterior anti-drip structures 22, and/or one or more baffle members 38, to keep water away from the inside of the air moving device 10.

With continued reference to FIGS. 5-9, the air moving device 10 can include additional structures that facilitate de-stratification. For example, the nozzle 30 of the air moving device 10 can comprise at least one stator vane 46. The stator vanes 46 can be positioned equidistantly in a circumferential pattern within the nozzle 30. The stator vanes 46 can further direct the volume of air that has entered through the plurality of air vents 26, has moved past the baffle member 38, and has moved into the rotary fan assembly 32 and further down into the nozzle 30. For example, the stator vanes 46 can be used to straighten a volume of air within the nozzle 30. The stator vanes 46 can be used to force a volume of air to move in a generally columnar direction downwardly towards the floor of a building or other structure, with minimal lateral dispersion, similar to the devices described for example in U.S. patent application Ser. No. 12/130,909, and U.S. patent application Ser. No. 12/724,799, each of which is incorporated in its entirety by reference herein. In some embodiments, the nozzle 30 can have no stator vanes 46.

As described above, water is often sprayed up towards a ceiling to clean the inside of the building. If an air moving device 10 is hanging from the ceiling, when the water is sprayed, it is anticipated that the water will typically be sprayed at an angle so as to clean around the air moving device 10, and will not be sprayed directly upwards where the water might flow directly up into the nozzle and through the stator vanes 46. The anti-drip structure 22 and baffle member 38 can be beneficial, therefore, to inhibit the water from entering the air moving device 10 after it has been sprayed towards the ceiling.

With continued reference to FIGS. 5-9, in some embodiments the stator vanes 46 can comprise one or more cutouts 48. The cutouts 48 can create space for insertion, for example, of an ionization cell (i.e. a PHI cell). The ionization cell can be used to increase the air quality. The cutouts 48 can form a void or opening in the middle of the nozzle 30, and the ionization cell (not shown) can be inserted into the opening for example during manufacturing. The volume of air moving through the air moving device 10 can run past, alongside, or through the ionization cell, and be cleaned.

With continued reference to FIGS. 8 and 9, the air moving device 10 can further comprise at least one anti-swirl member 50. The anti-swirl member 50 can be located within the interior space of the air moving device 12 formed by the housing member 12. In some embodiments, one or more anti-swirl members 50 can be attached to an interior surface of the upper housing section 14. The anti-swirl members 50 can be used to slow down and/or inhibit swirling of air within the interior space located above the rotary fan assembly 32. For example air can be swirling turbulently, at a top of the air moving device 10 after it has entered the device. The anti-swirl members 50 can extend into the space where the air is swirling and slow the air down, and/or redirect the air, so that the air is directed more linearly down towards the nozzle 30. It can be desirable to slow down and/or inhibit swirling of air, such that the air can be directed more easily in a generally columnar pattern down through the nozzle 30 with greater ease and efficiency. The anti-swirl members 50 can be used to inhibit turbulence within the air moving device 10. In some embodiments, the anti-swirl members 50 can comprise one or more ribs. The ribs can extend along an inside surface of the housing member 12. The ribs can inhibit a swirling pattern of air.

In some embodiments, the air moving device 10 can be a self-contained unit, not connected to any ductwork, tubing, or other structure within a room or building. The air moving device 10 can be a stand-alone de-stratification device, configured to de-stratify air within a given space. In some embodiments, the air moving device 10 can be used in large rooms or structures with high ceilings. For example, the air moving device 10 can be used in rooms or buildings that are 50 feet long by 60 feet wide, with high ceilings, though other size rooms or buildings are also possible.

In some embodiments, the air moving device 10 itself can have an overall height (extending from the top of the housing member 12 to the bottom of the nozzle 30) that ranges from between approximately one foot to four feet, though other ranges are also possible. For example, in some embodiments the air moving device 10 can have an overall height that ranges from approximately one foot to three feet. In some embodiments the upper section 14 of housing member 12 can have an overall outside diameter that ranges from approximately 8 inches to 36 inches, though other ranges are also possible. For example, in some embodiments the upper section 14 can have an overall outside diameter that ranges from approximately 12 inches to 24 inches. In some embodiments, the nozzle 34 can have an outside diameter that ranges between approximately five inches to 12 inches, though other ranges are possible. For example, in some embodiments the nozzle 30 can have an outside diameter that ranges from between approximately eight to ten inches. In some embodiments the air moving device 10 can have a motor with an overall power that ranges between approximately 10 and 760 watts, though other ranges are possible. In some embodiments the air moving device 10 can have a motor with an overall power that is approximately 740 watts.

Figure 2:
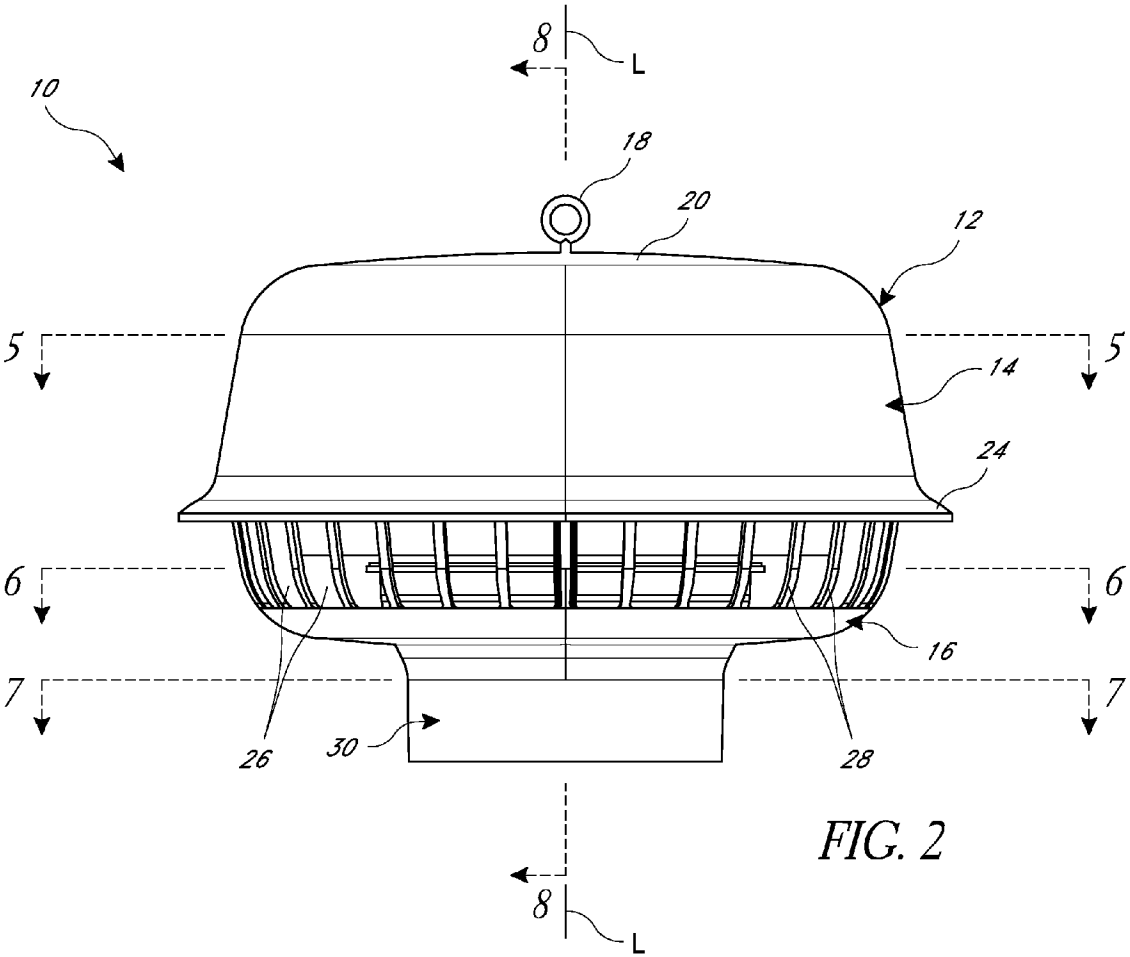
FIG. 2 is a front elevation view of the device of FIG. 1.
Figure 3:
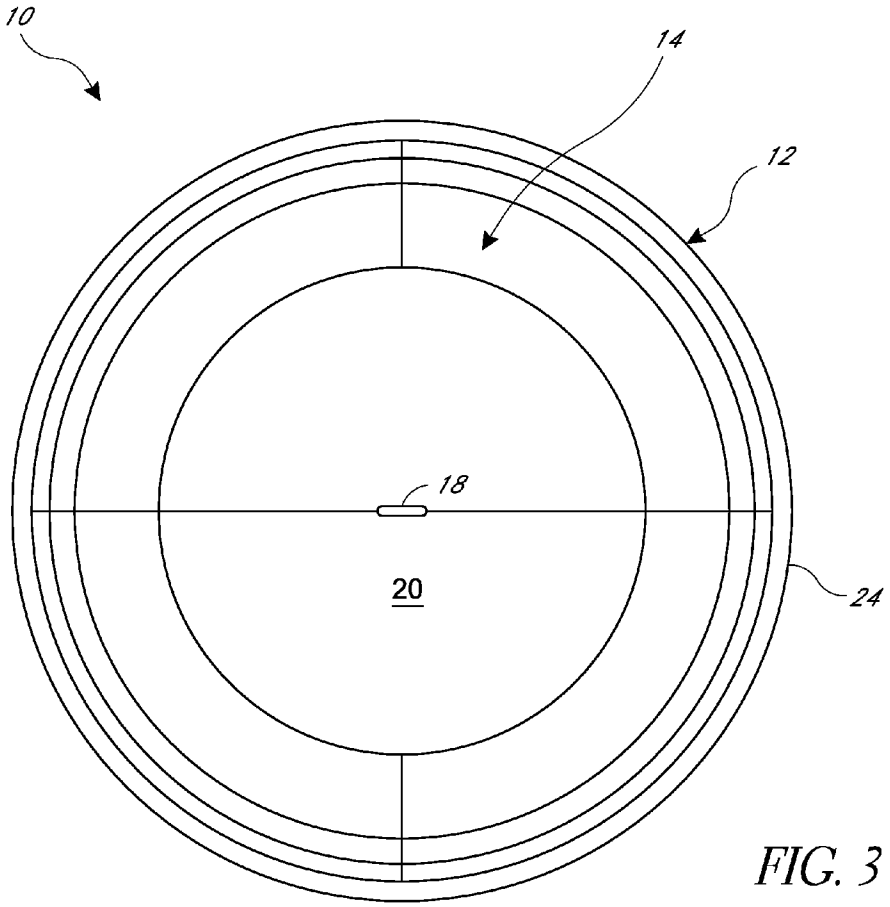
FIG. 3 is a top plan view of the device of FIG. 1.
Figure 4:
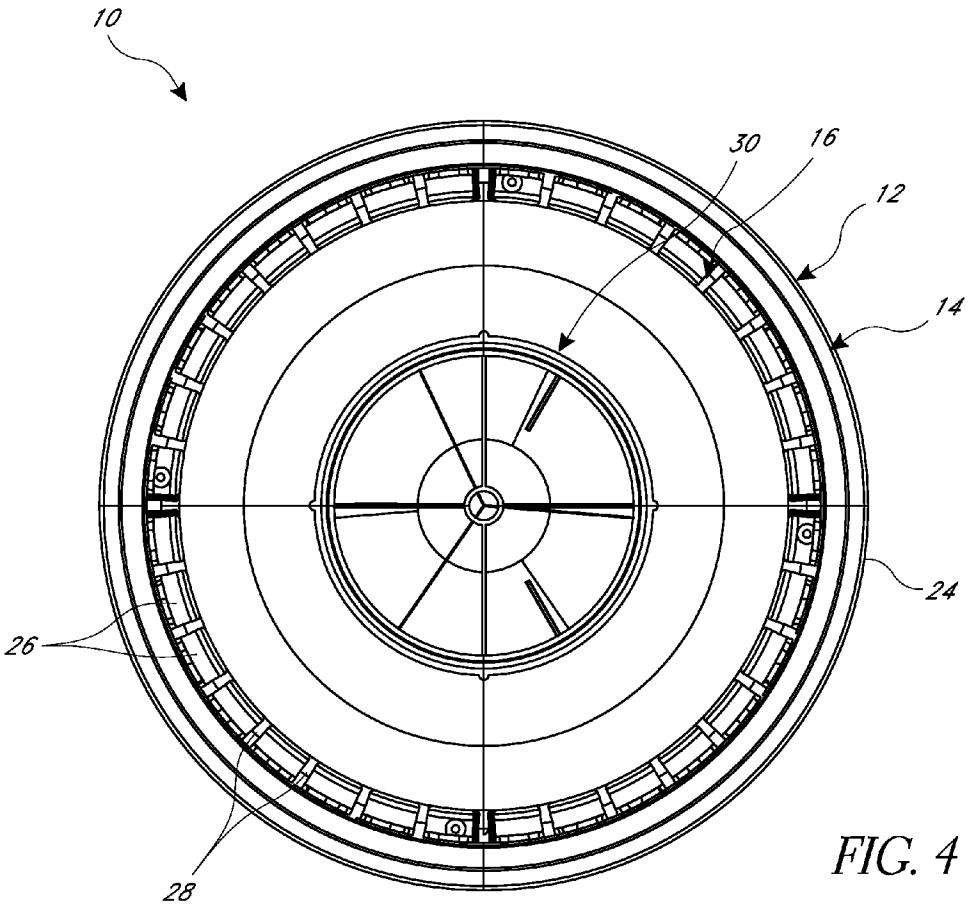
FIG. 4 is a bottom plan view of the device of FIG. 1.

With continued reference to FIGS. 2, 8 and 9, in some embodiments the air moving device 10 can comprise a longitudinal axis L that runs through a middle of the air moving device 10. The housing member 12 can comprise an opening 52 for insertion of the nozzle 30, and the nozzle 30 can comprise at least one spherical surface 54 configured to fit within the opening 52 such that the nozzle 30 can be adjusted angularly relative to the longitudinal axis L. For example, the nozzle 30 can rest within the opening 52, such that the spherical surface 54 contacts the housing member 12, and is not rigidly attached to the housing member 12. In this manner, the housing member 12 can act as a gimbol, allowing pivoted rotational movement of the nozzle member 30. The nozzle member 30 can be moved at an angle or angles relative the longitudinal axis L, so as to direct the column of air leaving the air moving device 10 towards different directions. In some embodiments, the nozzle 30 can be angled at least 10 degrees relative to the longitudinal axis L in one or more directions. In some embodiments, the nozzle 30 can be angled at least 15 degrees relative to the longitudinal axis L in one or more directions. In some embodiments the nozzle 30 can be angled at least 20 degrees relative to the longitudinal axis L in one or more directions. In some embodiments, the nozzle 30 can be angled at least 45 degrees relative to the longitudinal axis L in one or more directions. Other ranges are also possible. In some embodiments the nozzle 30 can self-lock in place once it has been repositioned. For example, the weight of the nozzle 30, and/or the coefficients of friction of the materials used to create the nozzle 30 and housing member 12, can be such that the nozzle 30 can frictionally lock itself in place in various positions. In some embodiments, the nozzle 30 and/or housing member 12 can incorporate one or more mechanical or other types of mechanisms for locking the nozzle 30 in place once it has been repositioned.

While use of a spherical surface on the nozzle 30 is described and illustrated, other types of mechanisms could also be used to permit relative movement of the nozzle 30, and/or to allow the nozzle 30 to be locked in place in various angular positions.

In some buildings, there are support beams, ductwork, conduit, wiring, or other structures that would otherwise block the flow of a columnar air moving device, or make it difficult for an air moving device to direct air to a desired area. Therefore, at least one benefit achieved by having a nozzle 30 that can be repositioned is the fact that the air moving device 10 can be positioned in or below a ceiling, some distance away from an area in need of de-stratification, and the nozzle 30 can simply be adjusted so as to direct the column of air towards that area of need.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combinations or sub-combinations of the specific features and aspects of the embodiments can be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An air moving device comprising:

a housing member forming an interior space within the air moving device, the housing member comprising a plurality of air intake openings for directing a volume of air into the interior space;

a lip member integrally formed with or attached to the housing member, the lip member forming an outer peripheral edge of the air moving device, the lip member flared outwardly away from the housing member so as to form a drip edge along the housing member, the portion of the housing member above the lip member defining a surface which has no through opening;

a rotary fan assembly mounted within the interior space, the rotary fan assembly comprising an impeller and a plurality of blades for further directing the volume of air; and a nozzle communicating with and extending downwardly from the rotary fan assembly, the nozzle comprising a structure for further directing the volume of air out of the air moving device, wherein the plurality of air intake openings is located circumferentially inward from the outer peripheral edge of the air moving device.

2. The air moving device of claim 1, wherein housing member comprises an upper housing member, the upper housing member forming a generally solid, dome-shaped structure.

3. The air moving device of claim 1, wherein the nozzle comprises at least one stator vane.

4. The air moving device of claim 1, wherein the housing member comprises at least one anti-swirl member.

5. The air moving device of claim 1, wherein the air moving device further comprises a baffle member disposed within the interior space, the baffle member configured to redirect the volume of air entering the plurality of air intake openings.

6. The air moving device of claim 1, wherein the air moving device comprises a longitudinal axis, the housing member comprises an opening for insertion of the nozzle, and the nozzle comprises at least one spherical surface configured to fit within the opening such that the nozzle can be adjusted angularly relative to the longitudinal axis.

7. The air moving device of claim 1, wherein the housing member comprises an upper housing member and a lower housing member, the upper housing member connected to the lower housing member.

8. The air moving device of claim 7, wherein the rotary fan is mounted to the lower housing member.

9. The air moving device of claim 7, wherein the lip member forms part of the upper housing member.

10. The air moving device of claim 9, wherein the lip member comprises an outwardly flared lower portion of the upper housing member.

11. The air moving device of claim 7, wherein the upper housing member comprises a first outer diameter, and the lower housing member comprises a second outer diameter, the first outer diameter being greater than the second outer diameter.

12. An air moving device comprising:

a housing member forming an interior space within the air moving device, the housing member comprising a plurality of air intake openings for directing a volume of air into the interior space of the air moving device;

a baffle member disposed at least partially within the interior space of the air moving device, the baffle member positioned at least partially circumferentially inward from the plurality of air intake openings and connected to the housing member and configured to redirect the volume air within the interior space;

a rotary fan assembly mounted in the interior space, the rotary fan assembly comprising an impeller, a plurality of blades, and an open upper end, the rotary fan assembly configured to further redirect the volume of air within the interior space; and a nozzle communicating with and extending downwardly from the rotary fan assembly, the nozzle comprising a structure for further directing the volume of air out of the air moving device, wherein the baffle member extends below the open upper end of the fan assembly.

13. The air moving device of claim 12, further comprising a lip member integrally formed with or attached to the housing member, the lip member forming an outer peripheral edge of the air moving device, the lip member flared outwardly away from the housing member so as to form a drip edge along the housing member, the portion of the housing member above the lip member defining a surface which has no through opening.

14. The air moving device of claim 12, wherein the nozzle comprises at least one stator vane.

15. The air moving device of claim 12, wherein the housing member comprises at least one rib member located within the interior space.

16. The air moving device of claim 12, wherein the air moving device comprises a longitudinal axis, the housing member comprises an opening for insertion of the nozzle, and the nozzle comprises at least one spherical surface configured to fit within the opening such that the nozzle can be adjusted angularly relative to the longitudinal axis.

17. The air moving device of claim 12, wherein the housing member comprises an upper housing member and a lower housing member, the upper housing member connected to the lower housing member.

18. The air moving device of claim 17, wherein the rotary fan is mounted to the lower housing member.

19. The air moving device of claim 18, wherein the lip member forms part of the upper housing member.

20. The air moving device of claim 19, wherein the lip member comprises an outwardly flared lower portion of the upper housing member.

* * * * *